US007339488B2

(12) United States Patent
Pennington et al.

(10) Patent No.: US 7,339,488 B2
(45) Date of Patent: Mar. 4, 2008

(54) THRESHOLD HAVING SAFETY LIGHTS

(76) Inventors: John W. Pennington, 3535 Burntleaf La., Hoover, AL (US) 35226; James Pennington, 720 Wold Pen Ridge, Pell City, AL (US) 35128

( * ) Notice: Subject to any disclaimer, the term of this patent is extended or adjusted under 35 U.S.C. 154(b) by 213 days.

(21) Appl. No.: 11/287,991

(22) Filed: Nov. 28, 2005

(65) Prior Publication Data

US 2007/0120699 A1 May 31, 2007

(51) Int. Cl.

| | |
|---|---|
| ***G08B 17/10*** | (2006.01) |
| ***G08B 3/00*** | (2006.01) |
| ***G08B 5/00*** | (2006.01) |
| ***G08B 23/00*** | (2006.01) |
| ***F21S 8/00*** | (2006.01) |
| ***E01F 9/00*** | (2006.01) |
| ***G09F 7/00*** | (2006.01) |

(52) U.S. Cl. ..... 340/691.1; 340/628; 340/693.5; 340/815.4; 362/145; 362/147; 362/152; 362/153; 362/153.1; 40/584

(58) Field of Classification Search ..... 340/628–632, 340/691.1, 693.5, 815.4; 362/145, 147, 152–153, 362/153.1; 40/584

See application file for complete search history.

(56) References Cited

U.S. PATENT DOCUMENTS

| | | | | |
|---|---|---|---|---|
| 4,649,376 | A | 3/1987 | Frank | |
| 5,130,909 | A * | 7/1992 | Gross | 362/153 |
| 5,961,072 | A * | 10/1999 | Bodle | 244/118.5 |
| 6,237,266 | B1 * | 5/2001 | Tassey et al. | 40/542 |
| 6,249,221 | B1 * | 6/2001 | Reed | 340/539.14 |
| 6,392,559 | B1 * | 5/2002 | Sharpe, Jr. | 340/825.72 |
| 6,646,545 | B2 * | 11/2003 | Bligh | 340/286.05 |
| 6,771,181 | B1 * | 8/2004 | Hughen, Jr. | 340/693.5 |
| D495,750 | S | 9/2004 | Lee | |
| 6,785,992 | B2 * | 9/2004 | Chiarucci | 40/596 |
| 6,848,798 | B1 | 2/2005 | Logan | |
| 6,859,145 | B2 * | 2/2005 | Wilker et al. | 340/693.5 |
| D504,705 | S | 5/2005 | Gregory | |
| 6,896,388 | B2 * | 5/2005 | George et al. | 362/84 |
| 7,125,136 | B1 * | 10/2006 | Dedic et al. | 362/152 |
| 2001/0013185 | A1 * | 8/2001 | Chien | 40/544 |
| 2005/0184864 | A1 * | 8/2005 | Picard et al. | 340/506 |
| 2005/0286247 | A1 * | 12/2005 | Peterson | 362/249 |

* cited by examiner

*Primary Examiner*—Benjamin C. Lee
*Assistant Examiner*—Lam Pham

(57) ABSTRACT

An emergency light system is located in the threshold subadjacent to the lower edge of an emergency egress door. The light system includes a plurality of lights mounted on a flexible backing strip in the threshold. The lights are connected to a switch that can be manually operated or operated by a sensor in a fire and/or smoke detection system associated with a room. The lights will be visible to a person crawling on the floor even if there is smoke in the room. The lights are easily installed in the threshold and will not be subject to abuse that might occur if the lights were mounted on the door itself.

4 Claims, 1 Drawing Sheet

EMERGENCY EXIT
5
10
12
14
16
18
20
30
32
40
50
52
60
66
70
80
90
92
94
96
98

THRESHOLD HAVING SAFETY LIGHTS

TECHNICAL FIELD OF THE INVENTION

The present invention relates to the general art of lighting, and to the particular field of emergency lighting.

BACKGROUND OF THE INVENTION

Although such alarm installations have been credited with the saving of many lives, there remain many instances of fires which have killed a substantial number of people because of the confusion associated with fires. Thus, it is well-known that the smoke and gases associated with a fire are generally the actual cause of death associated with a fire. Many people are overcome by the smoke before they can find an appropriate exit from the enclosure within which they are trapped. Thus, an audible alarm of the conventional fire alarm unit may not provide the necessary directional help. Obviously under ideal conditions and in the absence of confusion, one can trace the sound of the alarm. Apparently, the high state of confusion in the presence of a fire requires some further device or means. Visual devices have not apparently been constructed to provide the necessary additional means operable in the confusion associated with a fire in that the directional relationships and effects of existing devices appear significantly inadequate.

Accordingly, many lives are lost each year because people are trapped in burning indoor areas and are unable to locate an exit in heavy smoke. In many cases, fire alarms are properly activated and emergency exit signs are illuminated. However, typical alarms only warn that there is a fire or other emergency, not the location of an exit. There are conventional exit signs, but such are not typically associated and coordinated with an alarm system. Such emergency exit lights are usually placed over doors. Since smoke fills a room from the ceiling down, these lights are quickly obscured by smoke.

However, none of these devices are positioned on the exit door or directly illuminates the base of the exit. Rather, the devices illuminate an area near, above, or beside the exit. Thus, a person caught in a fire may be led to an area near an exit door but might then wander to the wrong side of the exit door or to an adjacent interior exit door, missing the exit door. A disoriented person may finally find the exit door after multiple seconds or after a minute. However, in a high heat and heavy smoke situation, a few seconds can be the difference between life and death. In addition, for a system to be truly effective, it must warn people in areas which have yet to be affected by the fire or other emergency condition.

Accordingly, there is a need for an improved detector actuated escape system that is located in an area of an exit door that will be visible to a person crawling on the floor during an emergency situation.

While some doors may have lighting on the bottom of the door, such lighting may be difficult to install and maintain because the door is moved during use and doors are generally not adapted to accommodate lights.

Therefore, there is a need for an improved detector actuated escape system that is easily installed and maintained and is located in an area of an exit door that will be visible to a person crawling on the floor during an emergency situation.

SUMMARY OF THE INVENTION

The above-discussed disadvantages of the prior art are overcome by an improved emergency detector exit door illumination escape system is disclosed to be used in conjunction with an exit door for aiding people in finding the exit door in the event of an emergency situation posing low visibility in a room. The exit lighting is installed in the threshold of the door so it is easily installed and maintained yet will be very effective in leading people to the exit door during an emergency situation when the room may be filled with smoke.

Using the emergency lighting system embodying the present invention will permit a person crawling on the floor to clearly see the exit door even if the room is otherwise filled with smoke.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figures 1, 2, 3:
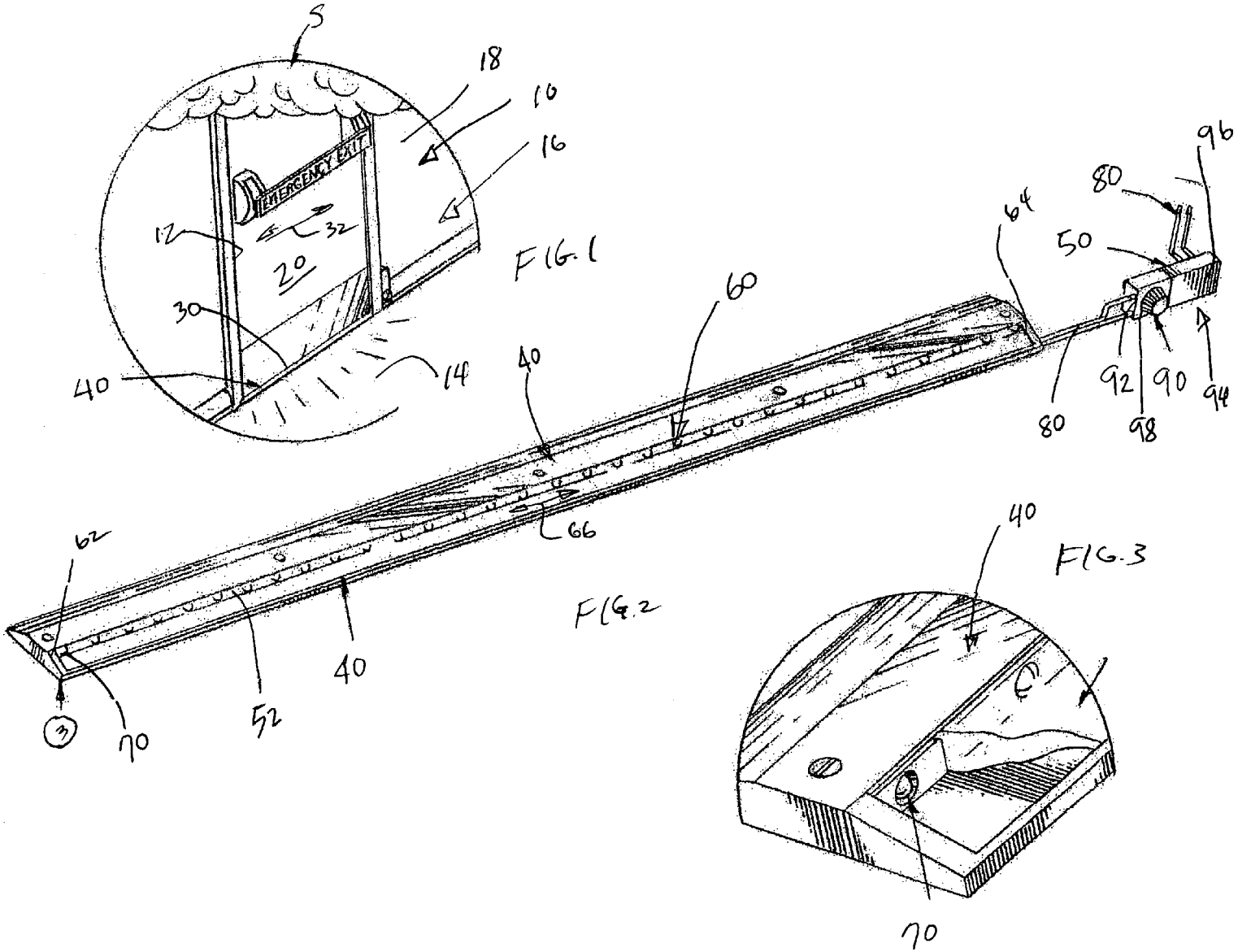
FIG. 1 is a perspective view of an emergency exit door embodying the present invention.
FIG. 2 is a perspective view of a threshold which has emergency lights therein and which is located immediately subadjacent to the emergency door.
FIG. 3 is a perspective view showing a detail of the threshold shown in FIG. 2.

Referring to the figures, it can be understood that the present invention is embodied in an emergency light system 10 that will signal the location of an emergency exit 12 in a manner that will be visible to someone located on floor 14 of room 16 defined, in part, by wall 18 in which emergency exit 12 is located.

Emergency light system 10 comprises an emergency door 20 mounted in wall 18 of room 16. Door 20 is adapted to provide emergency egress from the room. The door includes a first end 30 which is a lower end when the door is mounted in the wall as shown in FIG. 1. Door 20 has a width dimension 32.

A threshold 40 is located immediately subadjacent to lower end 30 of the door and is located in floor 14 associated with the room. An electrical system 50 is associated with the room and includes the usual circuitry, utility power and the like as will be known to those skilled in the art.

A lighting strip 60 includes a flexible backing strip 52 which is located in threshold 40 beneath the lower end of the door and includes a first end 62, a second end 64 and a length dimension 66 that extends between first end 62 and second end 64 of the flexible backing strip. Length dimension 66 of the flexible backing strip is essentially equal to width dimension 32 of the door.

A plurality of lights, such as LED light 70, are mounted on the backing strip at locations that are spaced apart from each other in the direction of longitudinal axis 66 of the backing strip. The lights are located on the floor subadjacent to the lower end of the door as can be understood from the teaching of the disclosure of the figures.

An electric lead 80 electrically connects the lights together in a manner known to those skilled in the art. A control circuit 90 includes a switch 92 electrically connected to the electric lead. The switch can be manually activated or connected to the sensor system that is associated with the room for detecting fire and/or smoke. Those skilled in the art will understand how to connect the switch to the sensor and since the details of such connection are not important to this invention, such details will not be presented. The switch can include a signal of some sort, such as a flasher or the like if suitable.

A power source 94 is electrically connected to the electric lead via the switch to supply power to the lights when the switch is activated. The power source can be a backup battery 96 such as those used to back up computer systems or the like, or can be the utility power system associated with the room.

A flasher 98 is electrically connected to the electric lead to be activated when the switch is activated. Operation of system 10 can be understood from the teaching of the foregoing disclosure and thus will not be presented in detail. In the event of a fire, smoke S will be present in the room and is likely to be located above floor level. Therefore, to escape the room, a person will have to move along the floor of the room. Since lights 70 of system 10 are located in the floor of the room, smoke S is not likely to obscure the lights and the lights will be visible to someone moving along floor 14. The lights will thus guide people to the emergency exit of the room. The lights will be easily installed beneath the threshold and are not likely to be damaged due to the protection offered by the threshold.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. An emergency light system comprising:

A) an emergency door mounted in a wall of a room and adapted to provide emergency egress from the room, the door including a first end which is a lower end when the door is mounted in the wall, and a width dimension;

B) a threshold located immediately subadjacent to the lower end of the door and which is located in a floor associated with the room;

C) an electrical system associated with the room;

D) a lighting strip which includes (1) a flexible backing strip which is located in the threshold beneath the lower end of the door and which includes a first end, a second end and a length dimension that extends between the first end of the flexible backing strip and the second end of the flexible backing strip, the length dimension of the flexible backing strip being essentially equal to the width dimension of the door, (2) a plurality of lights mounted on the backing strip at locations that are spaced apart from each other in the direction of the longitudinal axis of the backing strip, the lights being located on the floor subadjacent to the lower end of the door, and (3) an electric lead electrically connecting the lights together; and E) a control circuit which includes (1) a switch electrically connected to the electric lead, (2) a power source electrically connected to the electric lead via the switch to supply power to the lights when the switch is activated, and (3) a flasher electrically connected to the electric lead to be activated when the switch is activated.

2. The emergency light system defined in claim 1 wherein the power source includes a backup battery.

3. The emergency light system defined in claim 1 wherein the switch is manually operable.

4. The emergency light system defined in claim 1 wherein the switch is connected to a sensor which detects fire and/or smoke.

* * * * *